US006084617A

United States Patent [19]

Balazer

[11] Patent Number: 6,084,617

[45] **Date of Patent: *Jul. 4, 2000**

[54] NARROW BODY INKJET PRINT CARTRIDGE HAVING PARALLEL CONFIGURATION OF INTERNAL COMPONENTS

[75] Inventor: Leonard P. Balazer, San Diego, Calif.

[73] Assignee: Hewlett-Packard Company, Palo Alto, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/558,578

[22] Filed: Oct. 31, 1995

[51] Int. Cl.[7] ..... B41J 2/175

[52] U.S. Cl. ..... 347/86; 347/7

[58] Field of Search ..... 347/86, 85, 87, 347/89, 7; 137/143, 148, 150, 565, 907, 7, 81.1; 222/152, 95, 103, 630, 633, 20

[56] References Cited

U.S. PATENT DOCUMENTS

| | | | |
|---|---|---|---|
| 4,604,633 | 8/1986 | Kimura et al. | 347/7 |
| 4,885,595 | 12/1989 | Kaplinsky et al. | 347/85 |
| 5,040,002 | 8/1991 | Pollacek et al. | 347/87 |
| 5,280,300 | 1/1994 | Fong et al. | 347/87 |
| 5,367,328 | 11/1994 | Erickson | 347/7 |
| 5,426,459 | 6/1995 | Kaplinsky et al. | 347/87 |
| 5,450,112 | 9/1995 | Scheffelin | 347/87 |
| 5,453,772 | 9/1995 | Aono et al. | 347/87 |
| 5,539,436 | 7/1996 | Wilson et al. | 347/49 |
| 5,650,811 | 7/1997 | Seccombe et al. | 347/85 |
| 5,736,992 | 4/1998 | Pawlowski, Jr. | 347/7 |

FOREIGN PATENT DOCUMENTS 1242091 12/1959 France .

*Primary Examiner*—N. Le
*Assistant Examiner*—Shih-Wen Hsieh

[57] ABSTRACT

A narrow body inkjet print cartridge has internal components in an internal reservoir which receives ink through an inlet connected to an external ink supply. The internal components include an upstanding diaphragm mechanically coupled to an inlet valve for controlling ink replenishment from the external ink supply, and an upstanding filter which is spaced apart from the diaphragm, thereby limiting The width of one or more print cartridges placed side-by-side in a printer carriage.

18 Claims, 10 Drawing Sheets

NARROW BODY INKJET PRINT CARTRIDGE HAVING PARALLEL CONFIGURATION OF INTERNAL COMPONENTS

BACKGROUND OF THE INVENTION

The present invention relates to thermal inkjet printers characterized by a high volumetric efficiency in a compact print cartridge.

In any office product the overall size of the product has an effect on the cost and sell appeal of the product. In the inkjet printer market, the foot print of a personal printer is a key selling point if the printer can be made small enough to fit on a customer's desk top. In previous inkjet printers the printhead has been made with a small footprint. However, it is a goal of the present invention to permit a four cartridge color printer to have a footprint similar to such prior single pen printers.

When an inkjet product prints onto a page, the carriage must travel across the page such that every nozzle of every pen has an opportunity to reach the full paper area. In inkjet devices, the paper is generally driven along one axis of motion and the printhead is driven along a carriage scan axis which is perpendicular to the media advance axis. This invention addresses shortening the travel along the media scan axis, as well as reducing the overall size of a printhead cartridge that is supplied from an off-board ink reservoir.

For a single printhead product, the pen axis must travel the width of the paper plus the width of the printhead. For a four cartridge product, the carriage must travel the width of the paper, plus the width of the four-printheads plus the space between the printheads required to mount them. The paper width is fixed (unless it is driven relative to the pens by a third axis of motion).

As the product width is reduced, the volume of material required for fabrication and the size of plastic parts go down, reducing the molding machine size and thus the molding cost. The carriage is supported by beams and/or slide rods that must span the length of travel. As the length of travel increase, the stiffness requirements of those beams and rods cause their cross-sections, and thus their cost, to also increase. Thus any decrease in the spanned length is a cost benefit.

It is therefore an object of this invention to provide a cartridge for a inkjet having a substantially reduced dimension in the direction the pen is scanned during operation across the surface of the print medium.

A further object is to provide a inkjet printer of relatively small width, including a reduced width carriage one or more printheads of reduced width.

SUMMARY OF THE INVENTION

A thin body inkjet cartridge has an upstanding diaphragm for controlling ink replenishment from an off-axis ink reservoir, and an upstanding filter, thereby limiting the width of the cartridge.

DETAILED DESCRIPTION OF PREFERRED EMBODIMENTS

Figure 1:
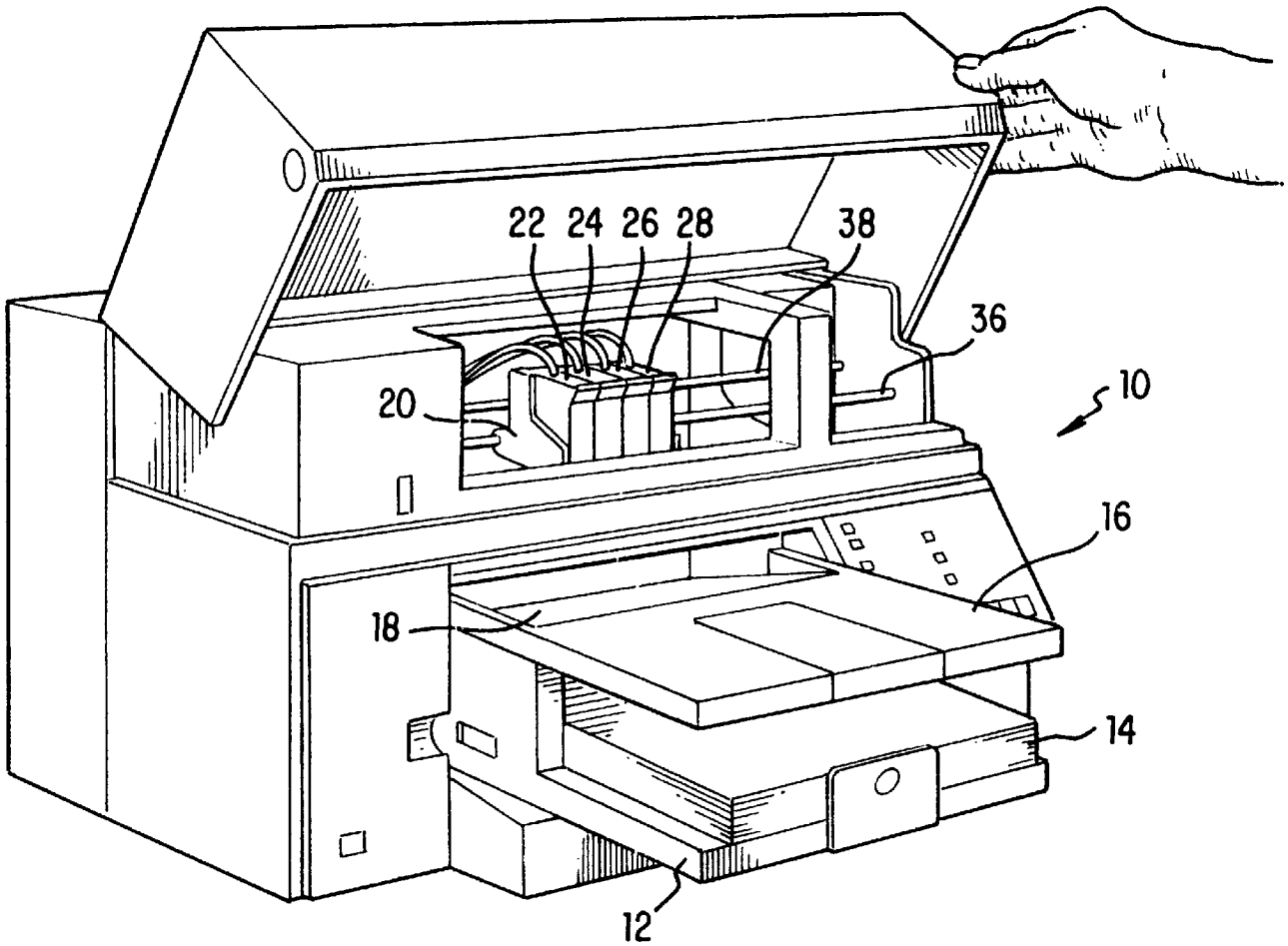
FIG. 1 is a perspective view of an exemplary color inkjet printer which may incorporate the features of the present invention.
Figure 2:
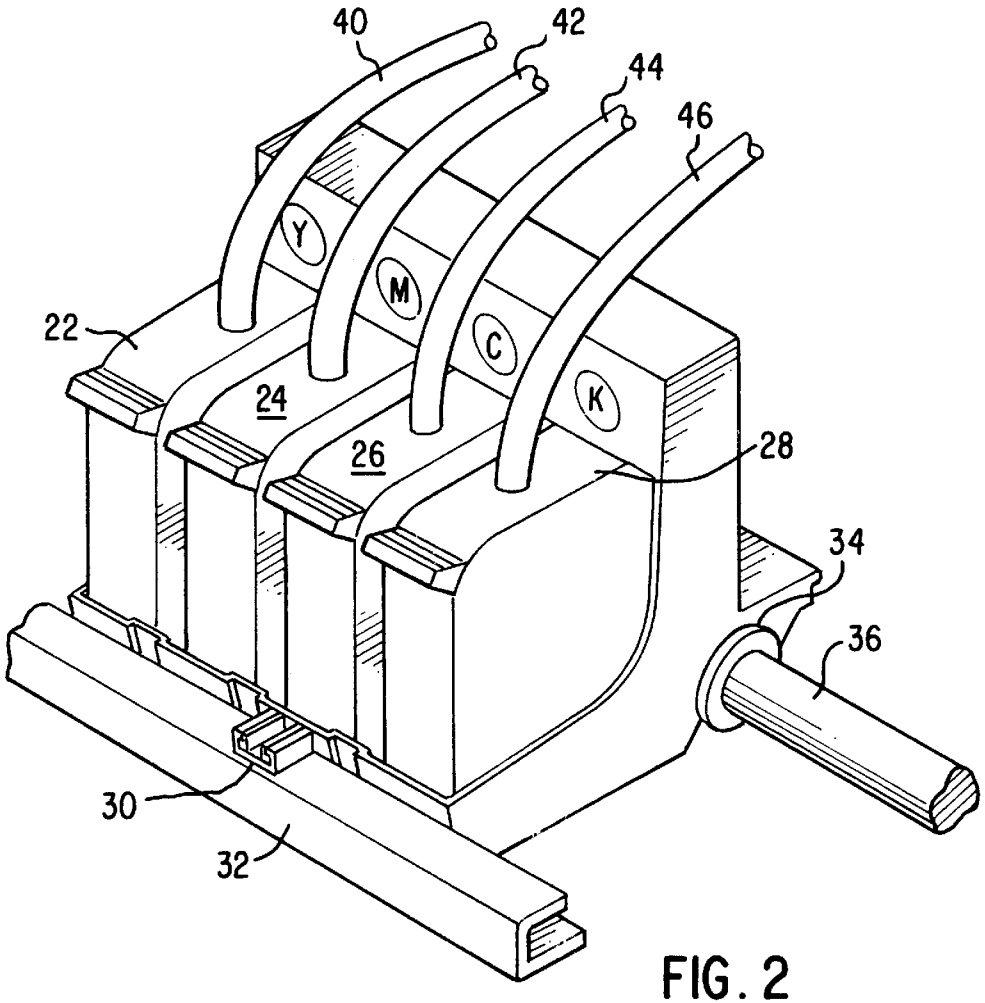
FIG. 2 is a close-up view of the carriage used in the printer of FIG. 1, showing four print cartridges each having a different color ink, and each connected to an off-board supply of ink.
Figure 12:
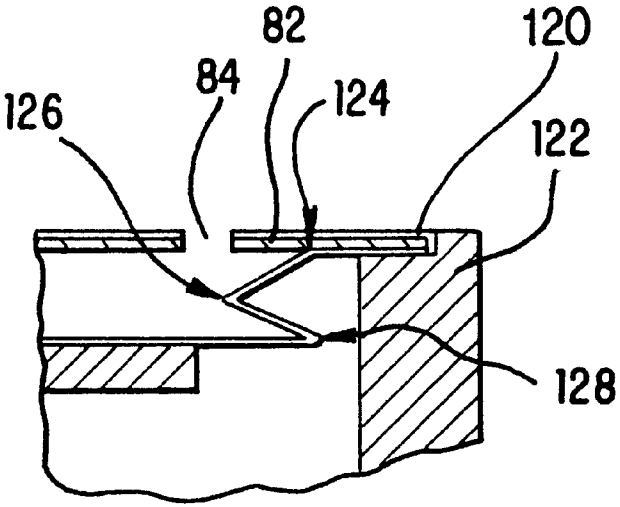
FIG. 12 is a fragmentary sectional view showing details of a bellows diaphragm attached to a regulator unit.

Even though the invention can be used in any printing environment where liquid ink is applied to media by a swath printer, the presently preferred embodiments of the invention are used in an inkjet printer of the type shown in FIG. 1. In particular, inkjet print 10 includes an input tray 12 containing sheets of media 14 which pass through a print zone, and are slowly fed past an exit 18 into an output tray 16. Referring to FIGS. 12, a movable carriage 20 holds print cartridges 22, 24, 26 and 28 which respectively hold yellow (Y), magenta (M), cyan and black (K) inks. The front of the carriage has a support bumper 30 which rides along a guide 32 while the back of the carriage has multiple bushings such as 34 which ride along slide rod 36. The position of the carriage as it traverses back and forth across the media is determined from an encoder strip 38 in order to be sure that the various ink nozzles on each print cartridge are selectively fired at the appropriate time during a carriage scan.

Each print cartridge has its own ink supply tube 40, 42, 44, 46 for ink delivery from an off-axis ink reservoir.

One-Piece Bellows Diaphragm

The unique features of the bellows diaphragm disclosed herein permits the construction of a differential pressure sensing and actuating diaphragm out of non-ductile polyethylene-aluminum composite foil without the necessity of joining any seams within the body of the foil when formed into bellows. Only the periphery of the formed bellows need be sealed to a mounting frame.

In this particular embodiment, the foil which is utilized is presently qualified and used in the construction of existing spring-bag ink reservoirs as shown in U.S. Pat. No. 5,450, 112 entitled LAMINATED FILM FOR INK RESERVOIR, which is incorporated herein by reference. Because of this, there is no need to re-qualify the foil for compatibility with existing ink formulations, nor for vapor retention qualities, nor for thermal joining and sealing properties to polyethylene frames of the type shown in the aforesaid patent reference.

The intention and application of bellows made in accordance with this invention is to actuate a valve which introduces ink into a thermal inkjet printing head's antechamber (i.e., regulator chamber) according to a desired negative pressure range within this chamber based on the specifications of the printhead. In contrast to prior pressure-actuated diaphragms which typically are made of composite materials such as fabric and rubber which allow undesirable stretching, compression and deformation, the diaphragm of the present invention changes position through the use of external and internal folds which occur at pre-defined locations on the diaphragm.

The combined actuation of the bellows diaphragm coupled to a valve is intended to replace negative pressure control/regulation by means of gravity, metal springs, sprung rubber diaphragms, or magnetic attraction (see, e.g. U.S. Pat. No. 5,040,002). A valve device of the type used herein when integrated into an inkjet printhead assembly will accept ink from any positive pressure source. This source may be a flaccid ink sac at some elevation above the valve or a remote positive-pressure reservoir with flexible-tube connections.

Narrow Compact Print Cartridge

The present invention is specifically designed to be implemented with an inkjet print cartridge that does not have an on-board ink reservoir. The invention therefore requires that ink be delivered to the printhead from an external source. Therefore the width of a narrow-body cartridge configuration which employs the present invention can be as small as the width of a thermal inkjet printhead itself. In practical cases this amounts to a single cartridge width of only about ¼ of an inch. This cartridge configuration lends itself to lateral stacking such that, for example, four such cartridges placed side-by-side would only be approximately one inch in total.

Nevertheless, the cartridge configuration of the present invention provides maximum areas for ink delivery elements for which large areas are advantageous or neccessary, namely, particle filter screens and pressure sensing diaphragms or bellows. Almost the whole lateral area of one side of the cartridge can be used to mount a particle-filter screen while almost the whole other side can be utilized by a bellows or other type of diaphragm. Thus, the need for a double filter screen of the type shown in U.S. Pat. No. 5,426,459 is eliminated.

Tab Circuit Interconnect Configuration

There are addition configuration changes with respect to the cartridge tab circuit interconnect which contribute to the effective operation of the inkjet printhead. First, the flex circuit interconnect pads are removed from the immediate vicinity of any ejected ink. Second, the interconnect pads are split into two sections which are brought close together on opposite sides of a thin mounting structure. Therefore the actual interconnect pad area is only half as large as in other tab circuit configurations. Third, the interconnect pads are mounted vertically behind the body of the cartridge and do not fix or set the width of the cartridge to be wider than other cartridge elements dictate.

Such a tab circuit interconnect scheme creates the possibility of using a unitary interconnect clamping technique for all four cartridges, rather than the individual cartridge clamping now in widespread use. This clamping technique applies to tab circuit interconnect pads which are split into two sections and mounted centrally behind the cartridge.

With this configuration, all the cartridge interconnect pads of multiple printheads which are located side by side can be clamped to their corresponding carriage interconnect pads with a single clamping mechanism. Rather than needing a connection pad clamping mechanism for each cartridge, only one mechanism is required for all the cartridges together, thus saving the parts and space required for multiple clamps.

After all cartridges are placed in a carriage, the free spaces between adjacent tab interconnect circuits are mechanically occupied by an assembly of spacer plates. Thereafter, lateral force is applied to the total assembly of tab circuit pairs and spacer plates, and all pads are forced together simultaneously with the same common force.

Off-Axis Ink Delivery System

Figure 3:
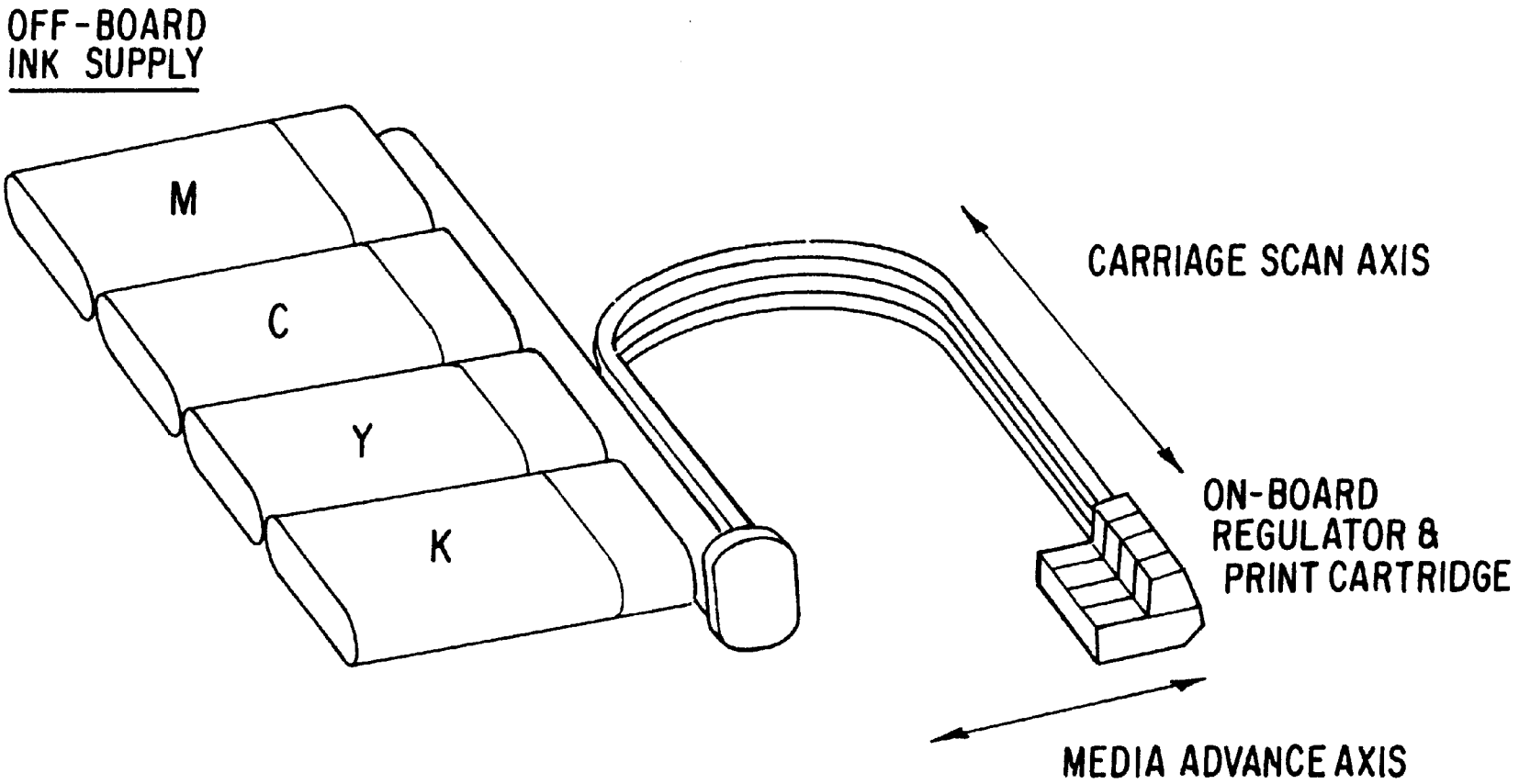
FIG. 3 is a schematic drawing of an inkjet printing system of the type shown in FIG. 2, wherein the print cartridges on the carriage each include an on-board regulator.
Figure 4:
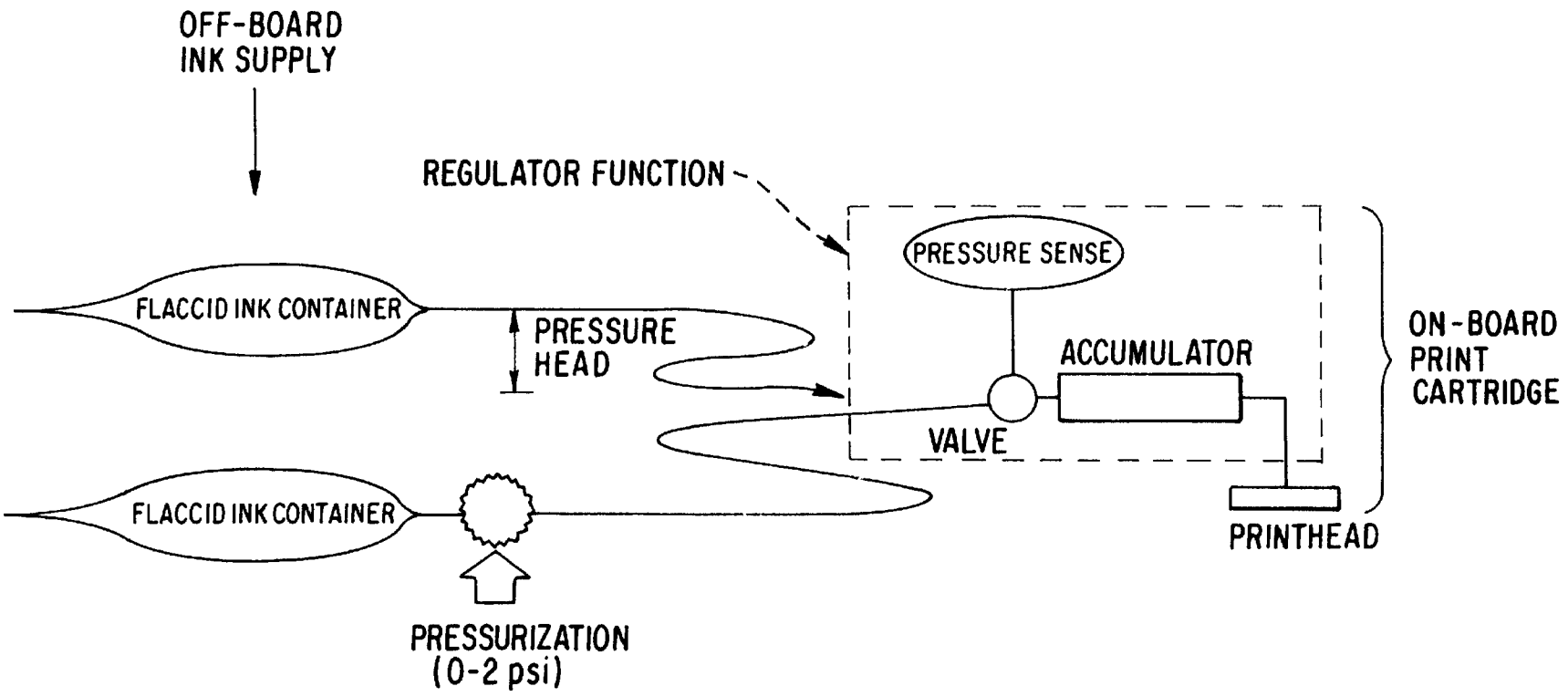
FIG. 4 is a schematic drawing showing the functional components of the inkjet printing system of FIG. 3.

FIGS. 3–4 show schematically an off-axis ink delivery system of the type used in the present invention. Although all the features of the invention could be implemented in a system where the regulator function is not on-board the carriage, the preferred form as shown in FIGS. 3–4 provides for an on-board regulator/valve system.

Figure 5:
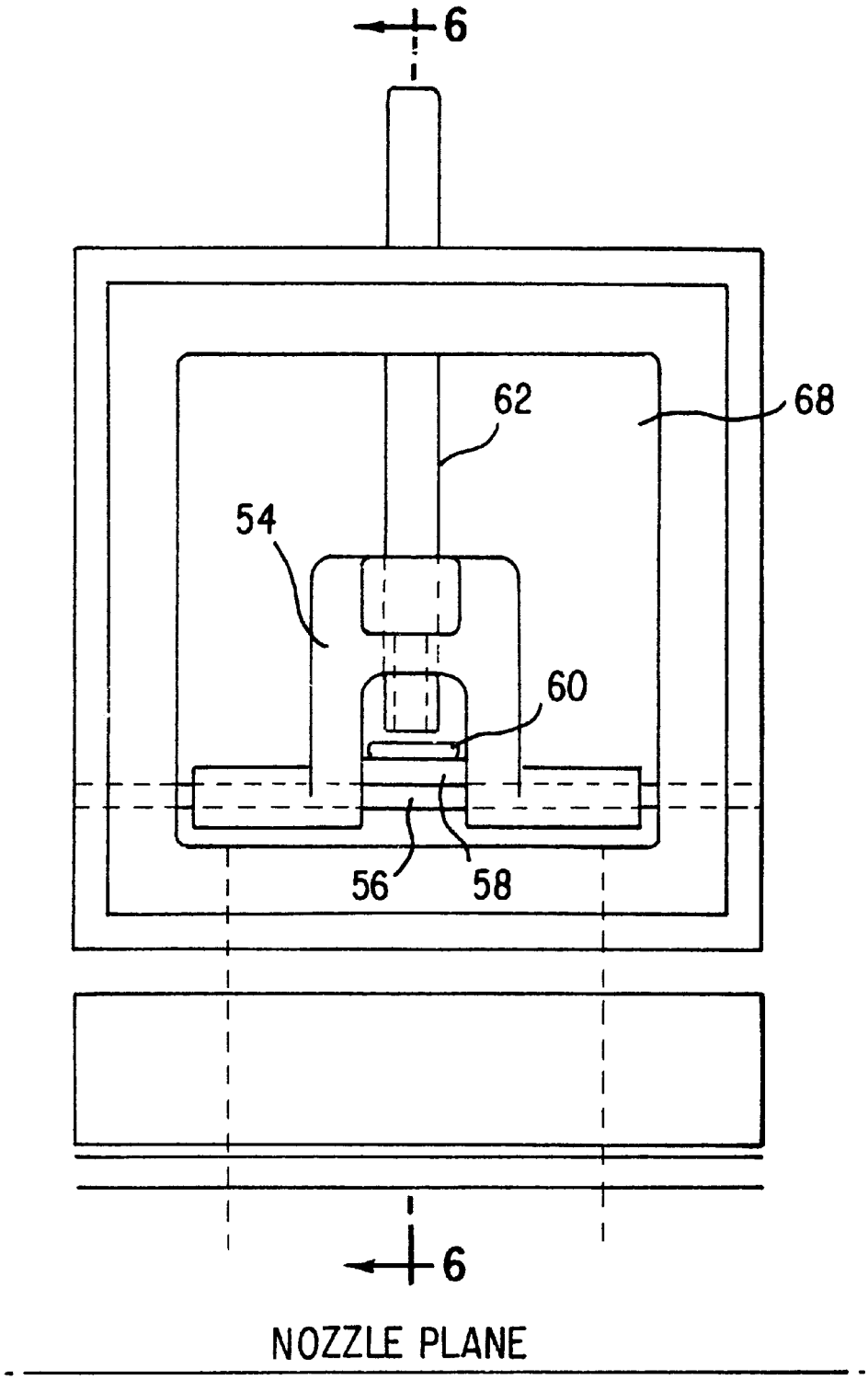
FIG. 5 is a side view of one embodiment of a regulator which incorporates a pressure-sensitive diaphragm and filter screen of the present invention.
Figure 6:
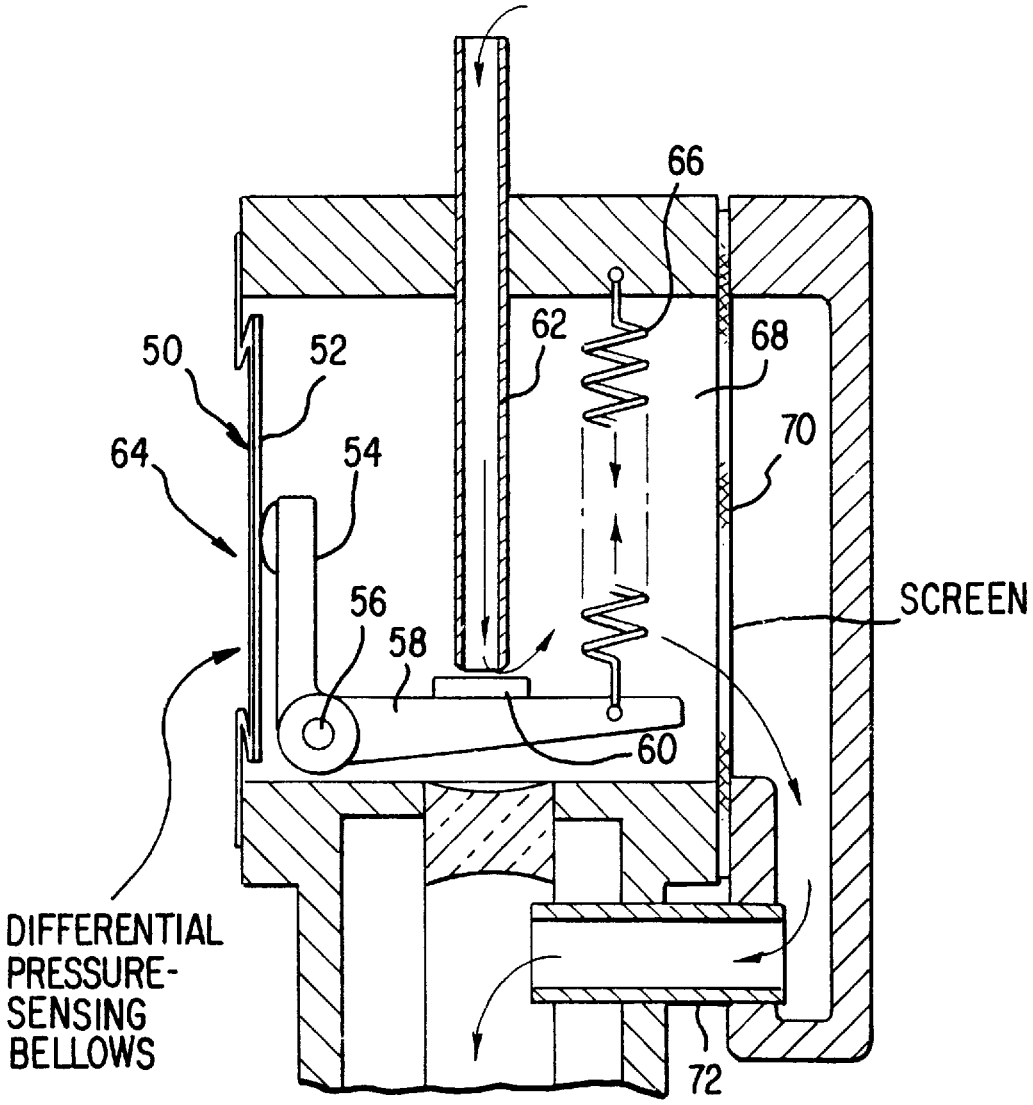
FIG. 6 is a sectional view of the regulator of FIG. 5 taken along the line 6—6 in FIG. 5.

FIGS. 5–6 show a bellows diaphragm 50, a central plaque 52, a first lever arm 54 which pivots about axis 56 to move a second lever arm 58 which has a valve seat 60 which opens and closes an inlet pipe 62. The ambient pressure shown at 64 is balanced by an internal spring 66. Ink which is temporarily stored in antechamber 68 passed through filter screen 70 through standpipe 72 down to a printhead.

Figure 7:
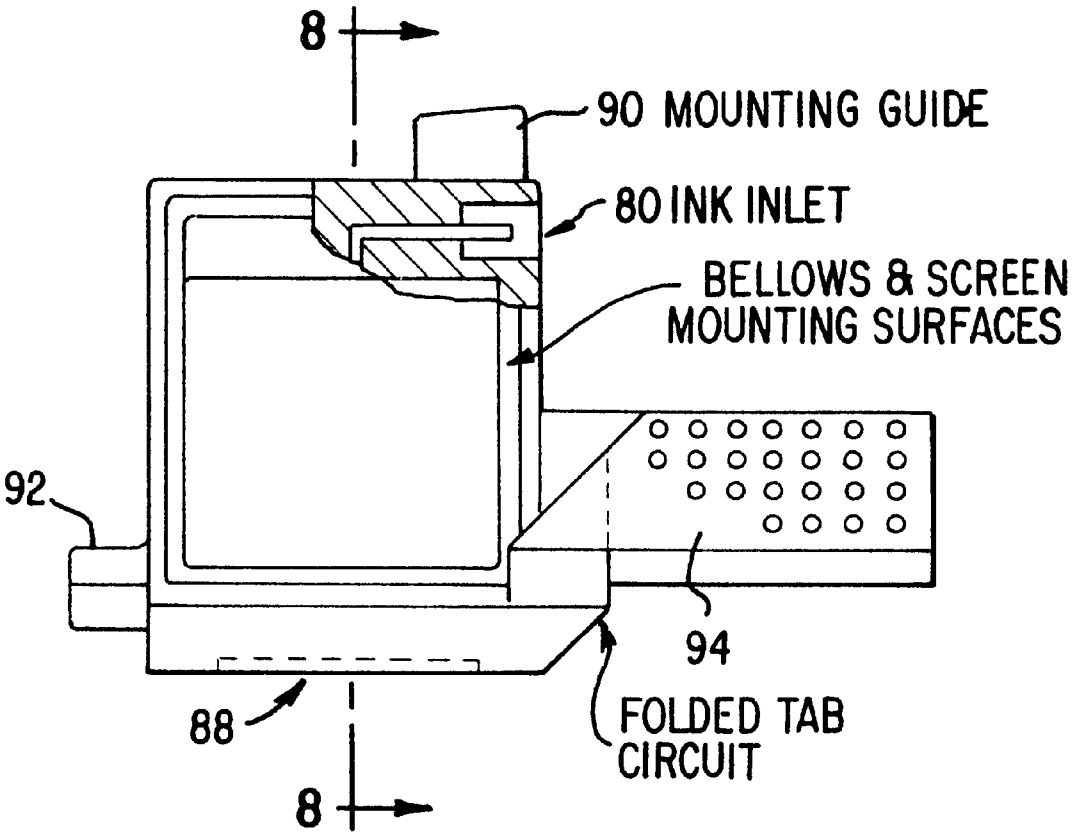
FIG. 7 is a side partially sectional view of another embodiment showing a narrow compact print cartridge incorporating a pressure-sensitive diaphragm, a filter screen, as well as a bifurcated tab circuit interconnect of the present invention.
Figure 8:
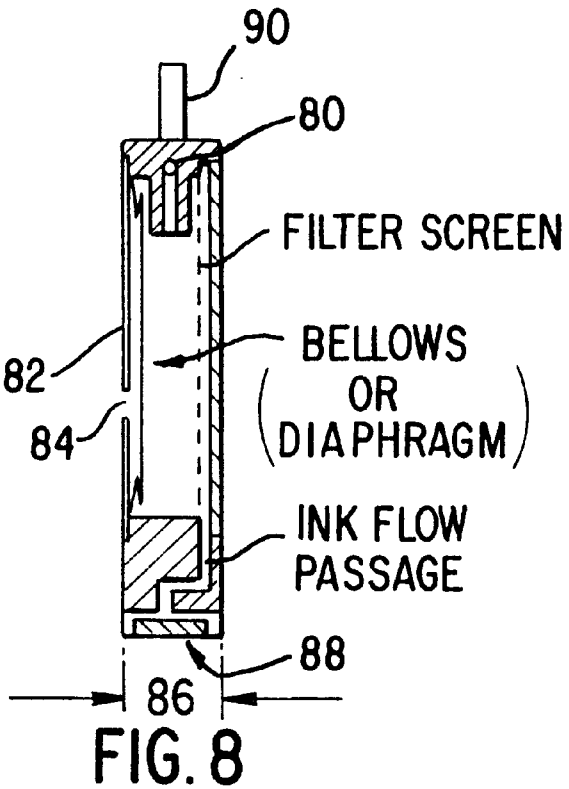
FIG. 8 is a sectional view of the narrow compact print cartridge of FIG. 7 taken along the line 8—8 in FIG. 7.

FIGS. 7–8 show a compact print cartridge having an externally located ink inlet 80 for removably receiving an ink supply tube (not shown). A protective plate 82 overlies the bellows diaphragm while allowing ambient air to circulate freely through vent 84. As shown, the print cartridge width 86 can be only slightly greater than the width of a printhead 88. Upper and front datum guides 90, 92 assure proper positioning of the print cartridges in the carriage. The tab circuit interconnect 94 is bifurcated and then folded around arms 93 to be in a vertical plane, with only half the pads showing on each side.

Figure 9:
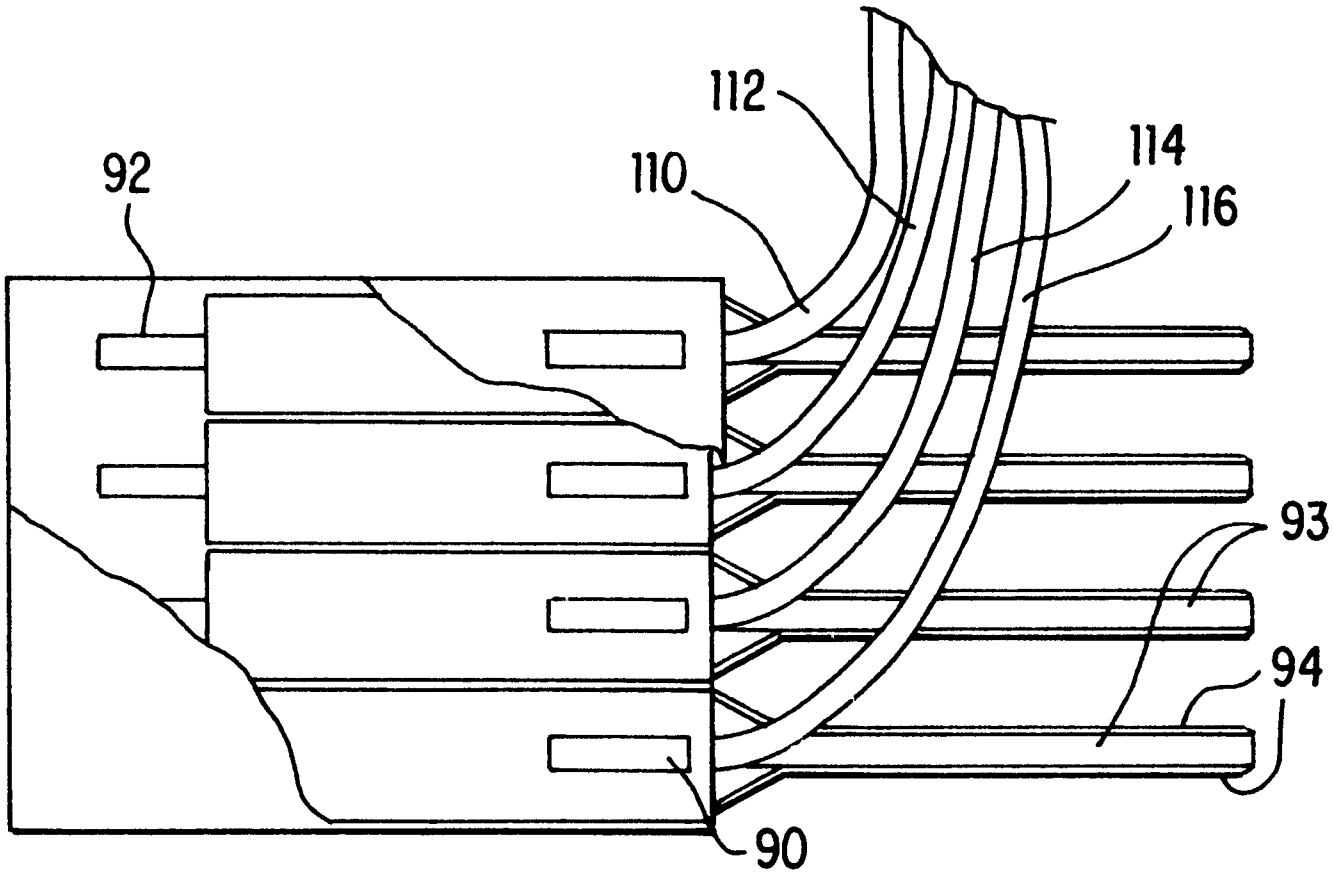
FIG. 9 is a top view showing how a plurality of the print cartridges of FIGS. 7–8 can be incorporated in adjacent relationship as a composite unit for mounting on a printer carriage with separate ink replenishment supply lines from an off-axis ink reservoir.
Figure 11:
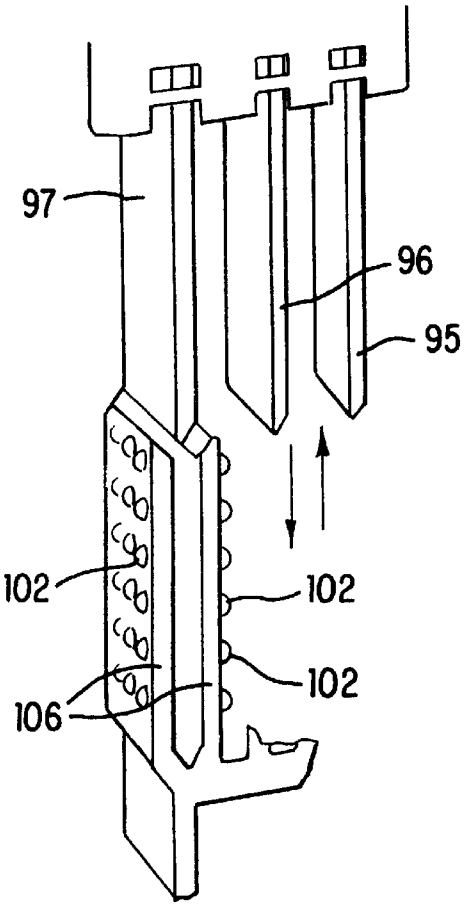
FIG. 11 shows an exemplary clamping device for securing the interconnection shown in FIG. 10.
Figure 10:
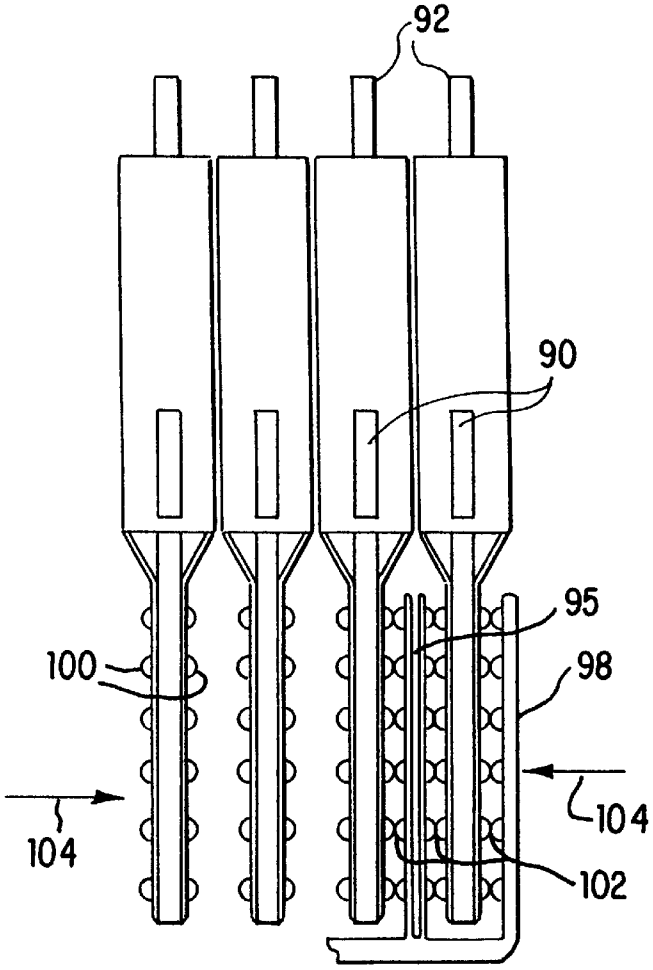
FIG. 10 is a top view showing how the bifurcated tab circuit interconnect is engageable with a matching carriage interconnect.

FIGS. 9–11 show how a plurality of compact cartridges can be fit together for mounting on a carriage, with flexible interior spacer plates 95, 96, 97 and rigid outer plate 98 providing the necessary clamping force to assure conductive contact between pads 100 on the cartridge and matching pads 102 on the carriage. In that regard, the interior spacer plates are inserted between U-shaped arms 106 which carry the carriage interconnect pads. 102. An auxiliary clamping force shown by arrows 104 can be provided if necessary. In FIG. 9, ink supply tubes 110, 112, 114, 116 are shown permanently attached to the regulator chambers, as an alternative to the detachable inlet shown in FIG. 7.

Figure 13:
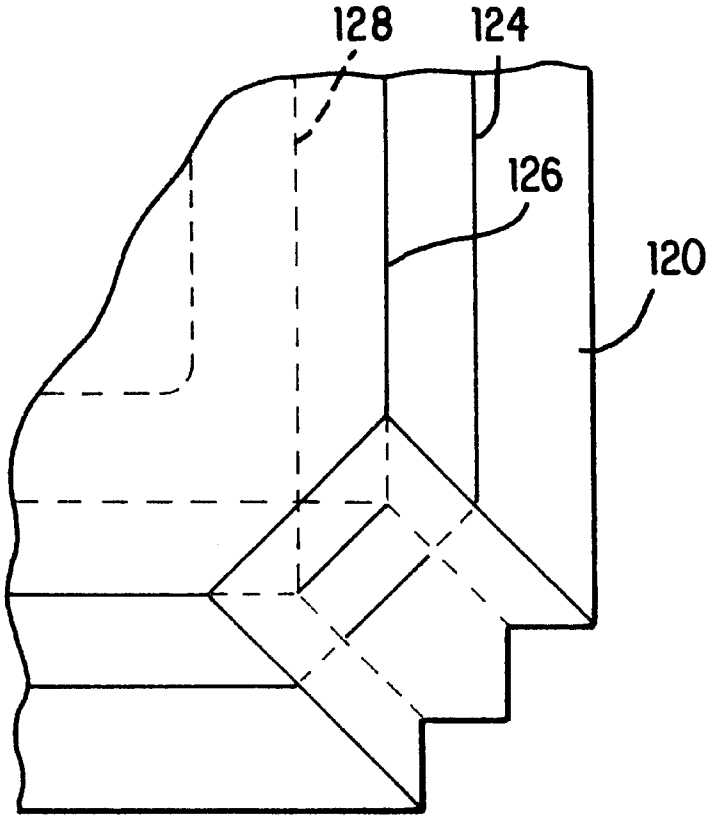
FIG. 13 is a top view of an unfolded corner portion of an the bellows diaphragm of FIG. 12.

FIGS. 12–13 show the details of the bellows diaphragm, which is heat sealed around edge 120 to a frame 122. Traveling from a fixed outer edge, a pre-determined folding pattern includes a first downward external fold 124, a second acute angle external fold 126, and a third acute angle internal fold 138 all of which are symmetrically positioned on all sides. A unique corner re-inforcement is provided as best shown in FIG. 13. This unique pre-folded pattern allows for expansion and contraction of the bellows diaphragm without any interference with the structural sealing qualities of the laminate forming the diaphragm.

It will therefore be appreciated by those skilled in the art that the invention provides a uniquely constructed regulator valve/diaphragm design which combines with a compact cartridge and newly configured flex-circuit interconnect to provide an efficient and reliable implementation of an off-axis ink delivery system. Various changes and improvements can be provided without departing from the spirit and scope of the invention as set forth in the following claims.

I claim as my invention:

1. An inkjet printhead cartridge for mounting on a carriage that moves in a generally horizontal carriage scan direction during a printing operation, comprising:

an inlet incorporated in the printhead cartridge to provide a connection from an off-carriage ink supply to an internal reservoir inside the printhead cartridge;

a valve for controlling said inlet;

an upstanding screen located inside the printhead cartridge in an ink path from said internal reservoir to a plurality of firing chambers for ejecting ink onto media, said screen positioned to filter ink passing along said path; and an upstanding diaphragm located in the printhead cartridge and extending in a generally vertical direction, which diaphragm is mechanically coupled to said valve to actuate said valve, said diaphragm being exposed to outside ambient air pressure in order to periodically open said valve in response to pressure changes to allow ink to pass from said off-carriage ink supply to said internal reservoir in the printhead cartridge.

2. The inkjet cartridge of claim 1 wherein said diaphragm expands horizontally in response to pressure differences between the ambient air pressure outside of the printhead cartridge and the ink pressure inside said internal reservoir of the printhead cartridge.

3. The inkjet cartridge of claim 1 wherein said upstanding diaphragm constitutes a single flexible wall portion of the printhead cartridge.

4. The inkjet cartridge of claim 1 wherein said upstanding screen is substantially parallel to and spaced apart from said diaphragm.

5. The inkjet cartridge of claim 4 wherein said inlet is located between said screen and said diaphragm.

6. The inkjet cartridge of claim 4 wherein said screen expands in a substantially vertical direction along one side of said internal reservoir in said ink path.

7. The inkjet cartridge of claim 1 further including a plurality of said cartridges capable of being mountable together side-by-side on the carriage.

8. An inkjet printing system comprising:

a plurality of printhead cartridges each having a separate ink chamber;

a carriage for holding said cartridges in side-by-side position as said carriage scans across media in a first direction;

a diaphragm in said ink chamber in said ink chamber extending in a second direction normal to said first direction;

an off-carriage ink supply connected to said cartridges through individual inlet in said printhead cartridges, respectfully;

a control valve in each printhead cartridge, said control valve mechanically coupled to said diaphragm and having a closed position preventing ink flow through each of said individual inlets; and wherein said control valve is mechanically actuated by expansion of said diaphragm to change said valve from said closed position to an open position to allow ink to pass from said supply to said separate ink chamber in each of said printhead cartridges.

9. The inkjet printing system of claim 8 wherein said plurality of printhead cartridges each includes a screen inside said ink chamber extending in said second direction in order to filter ink passing from said off-carriage ink supply to said printhead cartridges.

10. The inkjet printing system of claim 9 wherein said diaphragm and said screen both extend in a generally vertical direction, and said carriage scans in a generally horizontal direction.

11. The inkjet printing system of claim 8 wherein said diaphragm forms at least one wall portion of said ink compartment.

12. The inkjet printing system of claim 11 which further includes at least one filter screen inside said ink chamber extending in said second direction.

13. The inkjet printing system of claim 8 which further includes an arm connected between said diaphragm and said control valve to change said valve from said closed position to said open position.

14. The inkjet printing system of claim 8 which further includes a spring mechanically coupled to said valve to hold said valve in a normally closed position.

15. The inkjet printing system of claim 8 which further includes an arm operatively connected between said diaphragm and said control valve to change said valve from said closed position to said open position, and wherein said spring is attached to said arm.

16. The inkjet printing system of claim 15 wherein said arm and said control valve are located in said separate ink chamber of said printhead cartridges.

17. The inkjet printing system of claim 8 wherein said off-carriage ink supply is elevated relative to said separate ink chamber of said printhead cartridges in order to create a pressure head for passing ink through said inlets when said control valve is in said open position.

18. The inkjet printing system of claim 8 wherein said off-carriage ink supply is provided with positive pressurization for passing ink through said inlets when said control valve is in said open position.

* * * * *